US006994633B2

(12) United States Patent
Czaja et al.

(10) Patent No.: US 6,994,633 B2
(45) Date of Patent: Feb. 7, 2006

(54) GOLF SWING TRAINING APPARATUS

(75) Inventors: David Czaja, Norwalk, CT (US); Gil Tatarsky, Hartsdale, NY (US)

(73) Assignee: Katema, LLC, Kingston, NY (US)

( * ) Notice: Subject to any disclaimer, the term of this patent is extended or adjusted under 35 U.S.C. 154(b) by 418 days.

(21) Appl. No.: 10/383,327

(22) Filed: Mar. 7, 2003

(65) Prior Publication Data

US 2003/0176227 A1 Sep. 18, 2003

Related U.S. Application Data

(63) Continuation-in-part of application No. 09/988,360, filed on Nov. 19, 2001, now abandoned.

(60) Provisional application No. 60/249,740, filed on Nov. 17, 2000.

(51) Int. Cl.
*A63B 69/36* (2006.01)

(52) U.S. Cl. ..... 473/227; 473/226; 473/219; 473/276

(58) Field of Classification Search ..... 473/227, 473/207, 215, 216, 206, 219, 226, 231, 266, 473/276, 277, 229; 24/270, 271, 272, 3.12, 24/3.13; 403/321, 322.1, 322.4; 224/627, 224/628, 637, 638, 650, 651
See application file for complete search history.

(56) References Cited

U.S. PATENT DOCUMENTS 2,018,906 A * 10/1935 Winter ..... 24/271
3,595,583 A 7/1971 Oppenheimer
4,073,317 A * 2/1978 Ellis ..... 138/147
4,509,757 A 4/1985 Yuhara
4,582,325 A 4/1986 Yuhara
4,662,640 A 5/1987 Grander
4,667,624 A * 5/1987 Smith ..... 119/770
4,830,338 A 5/1989 Hannigan
5,136,757 A * 8/1992 Labonville ..... 24/271
5,149,099 A 9/1992 Radakovich
5,150,901 A 9/1992 Stawicki
5,299,802 A * 4/1994 Bouchet-Lassale ..... 473/206
5,423,548 A 6/1995 Bricker
5,441,271 A 8/1995 Briggs
5,451,060 A 9/1995 Dalbo
5,548,876 A * 8/1996 Oetiker ..... 24/271
5,658,203 A 8/1997 Shub
5,688,184 A 11/1997 Johnson
5,706,558 A * 1/1998 Sauer ..... 24/279
5,951,408 A 9/1999 Inman
6,142,434 A * 11/2000 Trost et al. ..... 248/218.4
6,165,079 A 12/2000 Czaja
6,473,945 B1 * 11/2002 Draper ..... 24/271

* cited by examiner

*Primary Examiner*—Nini F. Legesse
(74) *Attorney, Agent, or Firm*—McCarter & English, LLP

(57) ABSTRACT

A method and device for golf swing training is disclosed wherein a double pendulum model swing is replicated by defining a point on a golfer's chest about which a golfer's swing rotates and extending therefrom a inelastic flexible strap for attachment to the grip of a golf club. The inelastic flexible strap encourages the golfer to fully extend his arms throughout the golf swing to maintain a proper swing radius without inhibiting the movement of the golfer's wrists; therefore, allowing the golfer to experience the ideal golf swing.

12 Claims, 7 Drawing Sheets

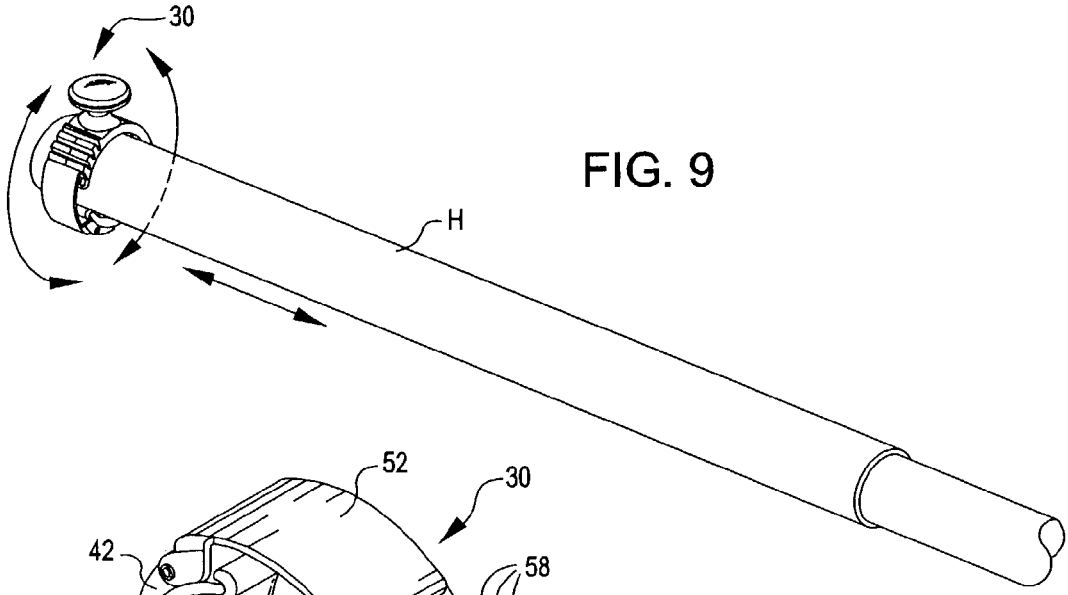
FIG. 9
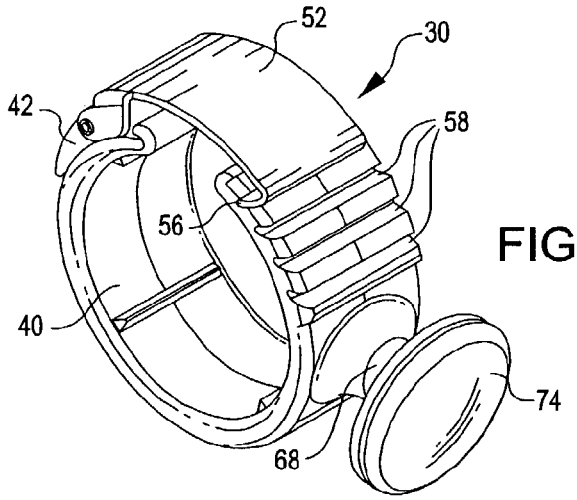
FIG. 10
FIG. 11
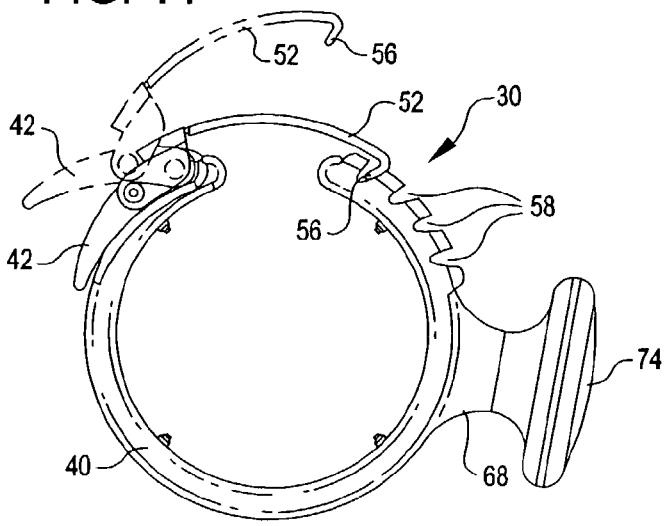

GOLF SWING TRAINING APPARATUS

This application claims the benefit of U.S. Provisional Patent Application Ser. No. 60/249,740, filed Nov. 17, 2000, and is a continuation-in-part of U.S. patent application Ser. No. 09/988,360 now abandoned filed Nov. 19, 2001.

BACKGROUND OF THE INVENTION

The present invention relates to a golf swing training apparatus and method. The disclosed apparatus and method allow golfers of all levels to perfect their golf swing. When used by a golfer the disclosed device encourages the golfer to replicate the ideal double pendulum model golf swing while also feeling the correct rotation of the clubface necessary to hit golf balls long and straight. Additionally, the apparatus provides a golfer with the necessary feedback regarding the feel of a correct golf swing and trains the golfer to consistently execute an ideal swing.

The United States Golf Association ("USGA"), golfs governing body, utilizes a machine named "Iron Byron" to test golf clubs and balls to ensure that both conform to USGA's regulations. Iron Byron hits a perfect golf shot—long and straight—every time. The ideal golf swing that Iron Byron mimics is a two lever or double pendulum model swing.

In a double pendulum model swing there are two levers connected by a hinge that is fixed to rotate about a fixed axis. The first lever (closest to the axis) corresponds to the golfer's shoulders and arms, while the second lever (below the hinge) corresponds to the golf club. The hinge corresponds to the golfer's wrists and hands. The present invention has been developed to accurately replicate Iron Byron's double pendulum motion on a human. The first lever is simulated by an adjustable strap that extends between a golfer's chest and his club, attaching to the grip end of the club. The second lever continues to be the golf club and the hinge continues to be the golfer's hands and wrists which are assisted by a "club clamp" that connects the adjustable strap to the golf club; this "club clamp" is designed to "dial-in" a pre-determined torque on the clubface.

The ideal model requires that the golfer's swing in each direction be made in a single inclined plane and that the hands of the golfer rotate around a fixed point somewhere on a golfer's chest. Moreover, angular momentum is conserved throughout the swing and during impact with the golf ball.

Many devices have been created for training golfers to produce a proper golf swing. Many of the known devices attempt to prevent the golfer from doing something detrimental to his swing, rather than encouraging the golfer to train proactively with his own clubs to create a proper swing. Additionally, known training devices fail to promote a double pendulum model swing motion or to give the golfer necessary feedback regarding the feel of a proper swing. Known devices are generally unable to train the golfer in the proper fundamentals necessary to make a lasting improvement on his golf swing.

For example, it is known to provide a "jacket" to create a link between the golfer's arms and the golfer's torso to guide him through the full range of motion of a golf swing. Another known device is in the form of an elastic loop that is worn over the golfer's head, rests on his shoulders and hangs in front of his chest and stomach with the lowermost portion of the loop held by the left hand as the left hand grips the golf club.

Still other training devices include an elastic cord with a grip that is worn over a golfer's head and rests around his neck, with the golfer grasping the grip and the club, and extending his arm applying tension to the cord during the swing. While tension is maintained in the cord throughout the swing, this device does not define the center of the golf swing and does not encourage a double pendulum motion.

Still yet another known golf swing training apparatus employs a harness and utilizes a weighted shortened shaft for practicing the swing, but may not be used with the golfer's actual golf clubs and to practice actually hitting golf balls.

This, the aforementioned devices inhibit the free motion of a golfer's arms and wrists, are limited in their ability to work with actual clubs, and hitting balls, fail to define the center of the golfer's swing, fail to address clubface rotation (which is a key element to striking a golf ball with a "square" clubface directing straight shots at the intended target, and/or fail to promote a double pendulum swing motion. Also, some prior art provides poor upper levers designed as bungee cords or fixed wands or rods that can be dangerous when used and actually promote poor golf fundamentals.

The present invention allows the golfer to reproduce the double pendulum model and reinforces through muscle memory the fundamentals of this ideal swing. One embodiment of the present invention overcomes the limitations of the prior art by utilizing a harness with a chest plate offering multiple mounting rings options and a uniquely contoured design to fit chests of most sizes of men, women and children, to define the ideal point on a golfer's chest about which a golf swing should rotate. A flexible yet inelastic and adjustable strap extends from the chest plate to a golf club requiring the golfer to maintain a proper radius throughout the swing. The present invention does not inhibit the hinged motion of a golfer's wrists which enables the transfer of angular momentum from the club face to the ball at impact. Moreover, a golfer may utilize their actual golf clubs and balls while training with this device.

Accordingly, it is an object of the present invention to obviate many of the above problems in the prior art and to provide a novel device and method for golf swing training.

It is another object of the present invention to promote a double pendulum model swing motion.

It is yet another object of the present invention to provide a novel device for golf swing training that allows for the free movement of a golfer's hands, wrists and arms.

It is still another object of the present invention to provide a novel device for golf swing training that is adjustable to fit golfers of various sizes and body types (men, women and children of many ages).

It is a further object of the present invention to provide a harness that defines an ideal point on a golfer's chest through the use of multiple rings about which a golfer should swing to initiate power when executing the perfect golf swing.

It is a further object of the present invention to provide an adjustable flexible yet inelastic strap between a golfer's chest and a golfer's club that encourages full extension of a golfer's arm throughout the golf swing and maintenance of a proper swing radius, both creating greater centrifugal force and clubhead speed while eliminating the inherent dangers and other limitations of the prior art.

It is still a further object of the present invention to provide a clamp hinging means which can be attached to a golf club in various positions to control the orientation of the club face, and produce the torques required to vary hand, wrist and arm rotation, which ultimately affects the curvature of ball flight.

These and many other objects and advantages of the present invention will be readily apparent to one skilled in the art to which the invention pertains from a perusal of the claims, the appended drawings, and the following detailed description of the preferred embodiments.

BRIEF DESCRIPTION OF THE DRAWINGS

FIG. 9 is a perspective view showing the club clamp of the training device of the present invention adjustably mounted on a golf club grip.

FIG. 10 is a perspective view of the club clamp of the training service of the present invention.

FIG. 11 is an end view of the club clamp of the training device of the present invention showing the latch release thereof.

DESCRIPTION OF PREFERRED EMBODIMENTS

With reference to the drawings, like numerals represent like components throughout the several drawings.

Figure 1:
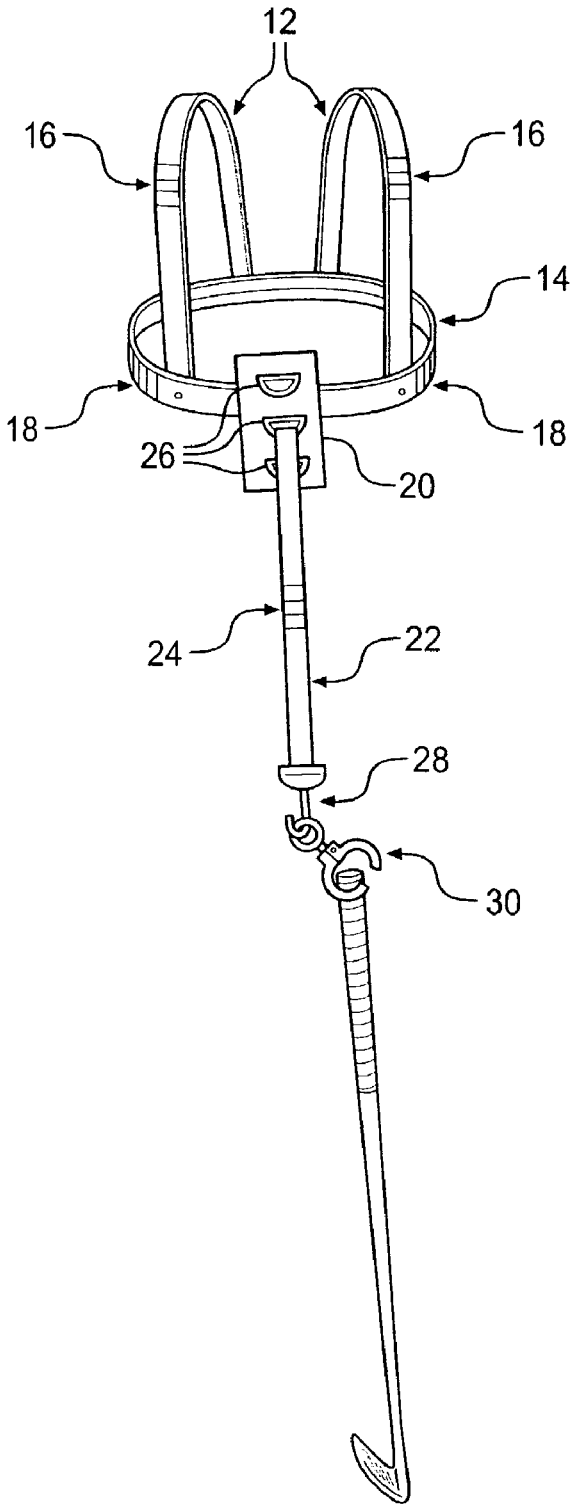
FIG. 1 is a pictorial illustration of one embodiment of the present invention from the front thereof with a golf club.
Figure 2:
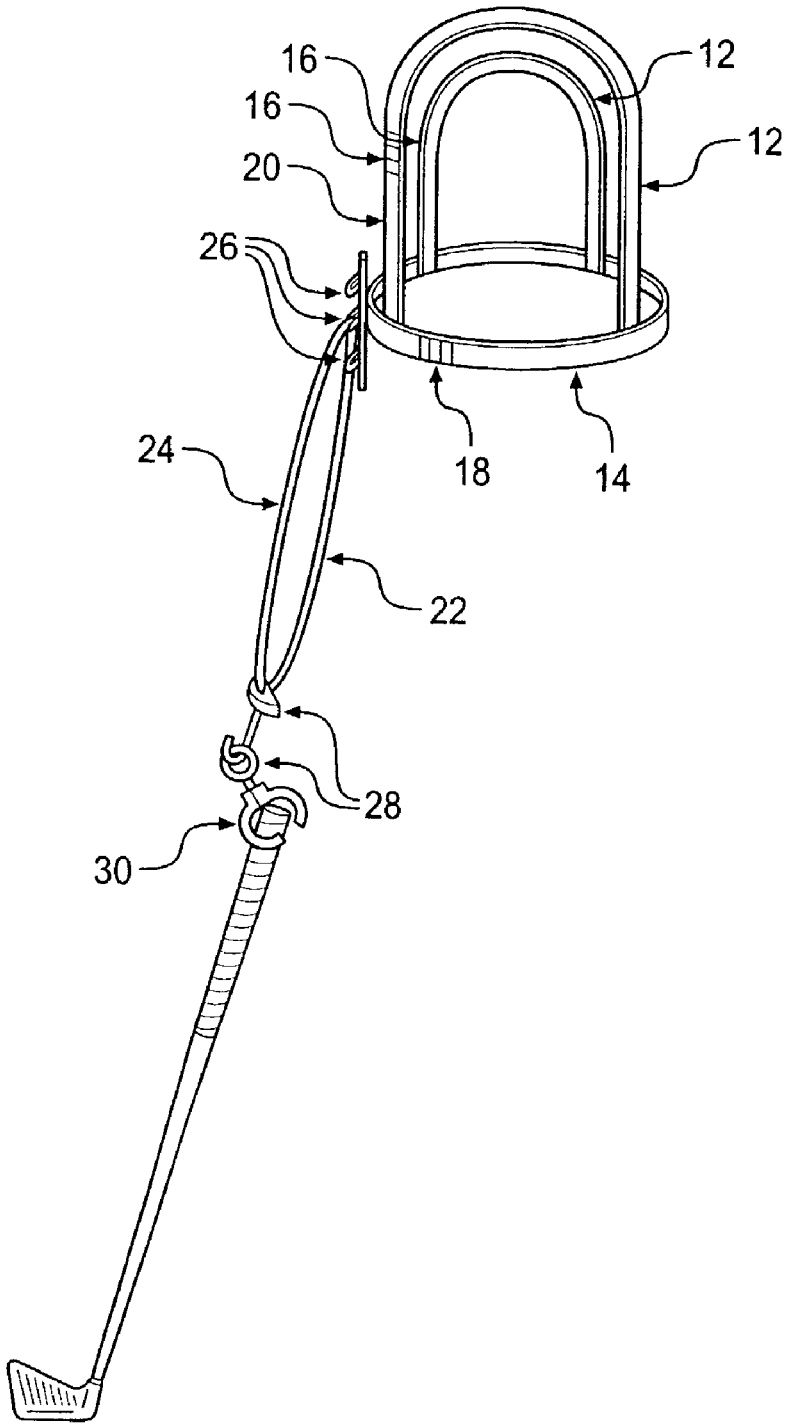
FIG. 2 is a pictorial illustration of the embodiment shown in FIG. 1 from the left side.
Figure 13:
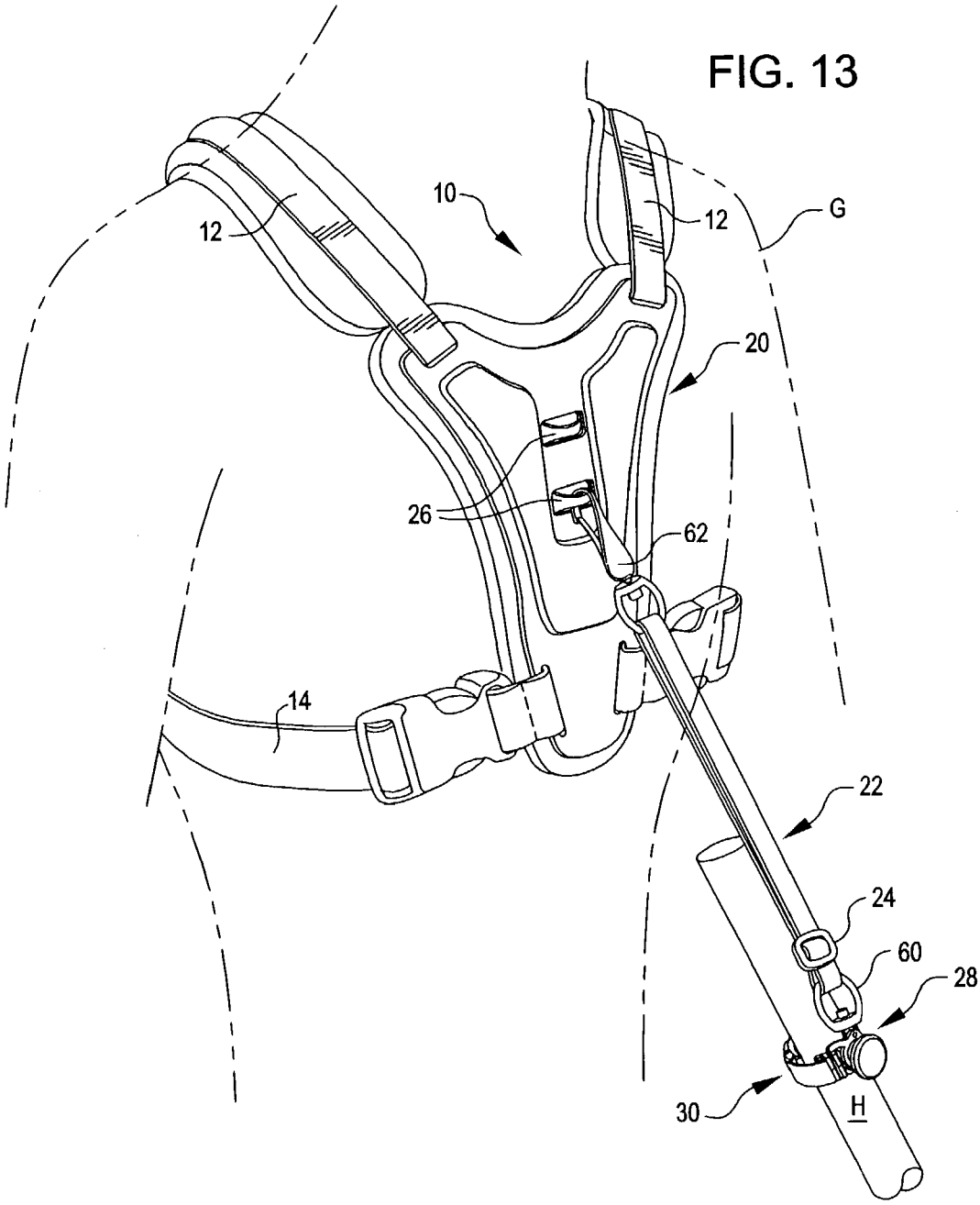
FIG. 13 is a perspective view of the training device of the present invention on a user and attached to a golf club grip.

With reference to FIGS. 1, 2 and 13, respectively, a front and side elevational view of one embodiment of the training device is illustrated. The adjustable harness 10 includes two shoulder straps 12 and a chest strap 14 that encircles a golfer's chest. The shoulder straps 12 and the chest strap 14 include adjustment means, 16 and 18, respectively, that may be a fastening tape consisting of a strip of nylon with a surface of minute hooks that fasten to a corresponding strip with a surface of uncut pile, buckles, hooks or other suitable conventional means to adjust the size of the harness 10. The harness 10 is adjustable so that it may fit golfers of various size (men, women and children of most ages) and must be properly fitted to achieve maximum training benefits.

With continued reference to FIGS. 1, 2 and 13, a chest plate 20 is attached to the chest strap 14 of the harness 10. The chest plate 20 may be sewn, riveted, glued or otherwise secured to the chest strap 14. The chest plate 20 should be attached to the chest strap 14 and when properly fitted should be positioned generally midway between the golfer's shoulders and level with his armpits to define a point about which the golfer should swing. In the ideal golf swing, there is a point generally midway between a golfer's shoulders and level with his armpits about which the ideal golf swing rotates.

Attached to the chest plate 20 is a inelastic flexible strap 22 that includes an adjustment means 24 for altering the length of the inelastic flexible strap 22. By making the inelastic flexible strap 22 slightly shorter than the actual length of his arms, a golfer will be encouraged to maintain the proper amount of extension and radius away from the chest plate 20 throughout the swing and thus the golfer will learn the "feel" of an ideal golf swing. The inelastic flexible strap 22 may be constructed from any flexible fabric or material that can support the tensile forces associated with a golf swing without inhibiting the swing motion. Inelastic flexible strap 22 is comprised of a flexible yet inelastic material, preferable a synthetic organic polymer, that is upper lever 34 of FIGS. 3, 4 and 5, below. There are inherent dangers of utilizing a rigid tube or wand like structure to guide a golf club while actually striking golf balls. Also there is a need for a perfect balance of flexibility and rigidity to capture the feel needed to duplicate the double pendulum swing model that rigid structures lack. In testing, such rigid devices have caused trauma to the chest arms and wrists of the end user. While these inherent dangers have been overcome in the present invention, a likewise disastrous effect can be seen if the material is made elastic. It has been shown mathematically by using a bungee like elastic material to represent the upper lever 34 of the 2-lever model of FIGS. 3, 4 and 5 would produce an infinite number of lever lengths, none of which could be consistently replicated for training resulting in a useless training device. One end of the inelastic flexible strap 22 may be attached to the chest plate 20 by a ring or attachment point 26, or other suitable fastener that will allow for free movement of the strap throughout the swing. Preferably, as shown in FIGS. 1 and 13, more than one ring or attachment point 26 are present. Most preferably, two or three rings or attachment points 26 are present, disposed vertically with respect to one another on chest plate 20 such that the training device of the present invention can be employed by golfers having different fulcrum locations of their golf swings with respect to their torsos. The purpose of multiple rings is to offer the golfer an option to properly locate the ideal fulcrum (fixed axis) location of the double pendulum professional swing.

Connected to the unattached end of the inelastic flexible strap 22 is a swivel buckle 28 which secures a club clamp 30 to the inelastic flexible strap 22. The swivel buckle or rotatable fastener 28 is free to rotate with the natural motion of the golfer's arms and wrists throughout a golf swing. When training with this device, an actual golf club is secured to the club clamp 30. Alignment of the club clamp 30 is variable, allowing the golfer to intentionally curve the ball or hit it straight while experiencing the desired amount of club face rotation.

Figure 4:
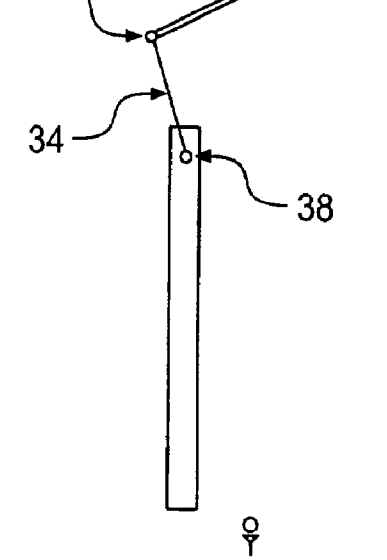
FIG. 4 is a schematic illustration of a double pendulum model golf swing at the top of the back swing.
Figure 5:
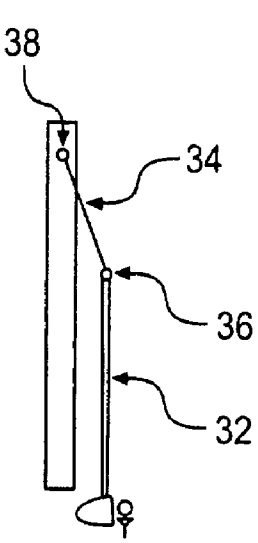
FIG. 5 is a schematic illustration of a double pendulum model golf swing immediately before the clubface impacts the golf ball.
Figure 3:
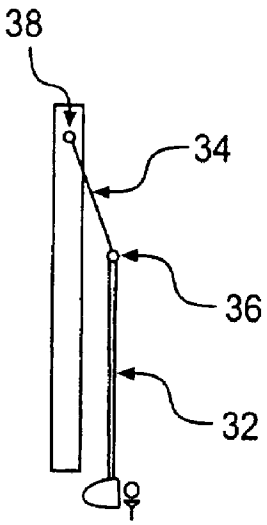
FIG. 3 is a schematic illustration of a double pendulum model golf swing at address.

With reference to FIGS. 3, 4 and 5, the double pendulum model golf swing is illustrated at address, at the top of the back swing and immediately before impact, respectively. The essential elements necessary for performing this swing motion include the lower lever 32 and upper lever 34. Connecting the lower lever 32 with the upper lever 34 is the hinge 36. The upper lever 34 rotates about a fixed point 38.

Figure 8:
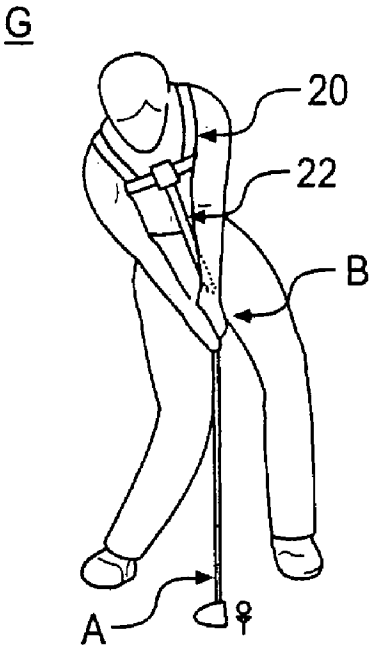
FIG. 8 is an illustration of a golfer wearing the embodiment of FIGS. 1 and 2 immediately before the clubface impacts the golf ball.
Figure 7:
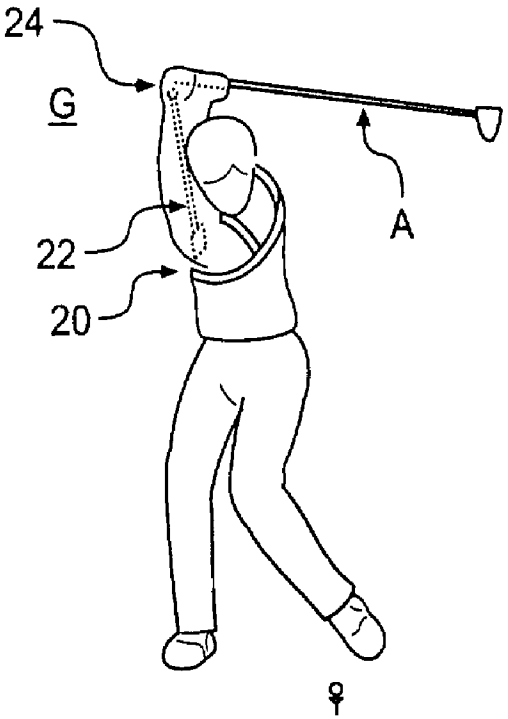
FIG. 7 is an illustration of a golfer wearing the embodiment of FIGS. 1 and 2 at the top of the back swing.
Figure 6:
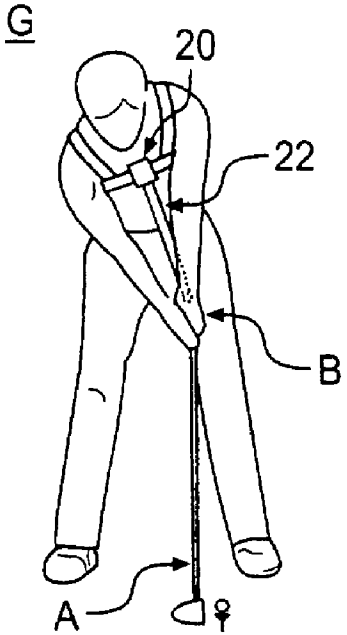
FIG. 6 is an illustration of a golfer wearing the embodiment of FIGS. 1 and 2 addressing the golf ball.

With reference to FIGS. 6, 7, and 8, a golfer wearing an embodiment of the present invention is illustrated addressing the golf ball, at the top of the back swing and immediately before impact, respectively. The present training device has been developed to accurately replicate the double pendulum model golf swing. A golfer G when wearing the device executes a double pendulum model golf swing as is evident from comparing FIGS. 3, 4 and 5 with FIGS. 6, 7 and 8. The golf club A parallels the lower lever 32 and the inelastic flexible strap 22 simulates the upper lever 34. The hinge 36 corresponds to the golfer's hands and wrists B. The fixed point 38 about which the golf swing rotates is the chest plate 20.

Next referring to FIGS. 9 through 15, the individual components an embodiment of the training device of the subject invention are shown.

As shown in the FIGS. 9 through 12, club clamp 30 has a hollow body or annulus 40 preferably comprised of a flexible yet resilient material such as, for example a synthetic organic polymer, that allows annulus 40 to be removably yet tightly secured to golf club grip H whereby annulus 40 can be positioned at a plurality of locations along the longitudinal axis of golf club grip H, which often tapers along this longitudinal axis, as well as positioned in numerous locations radially around grip H upon axial rotation of annulus 40, as best shown in FIG. 9.

Figure 12:
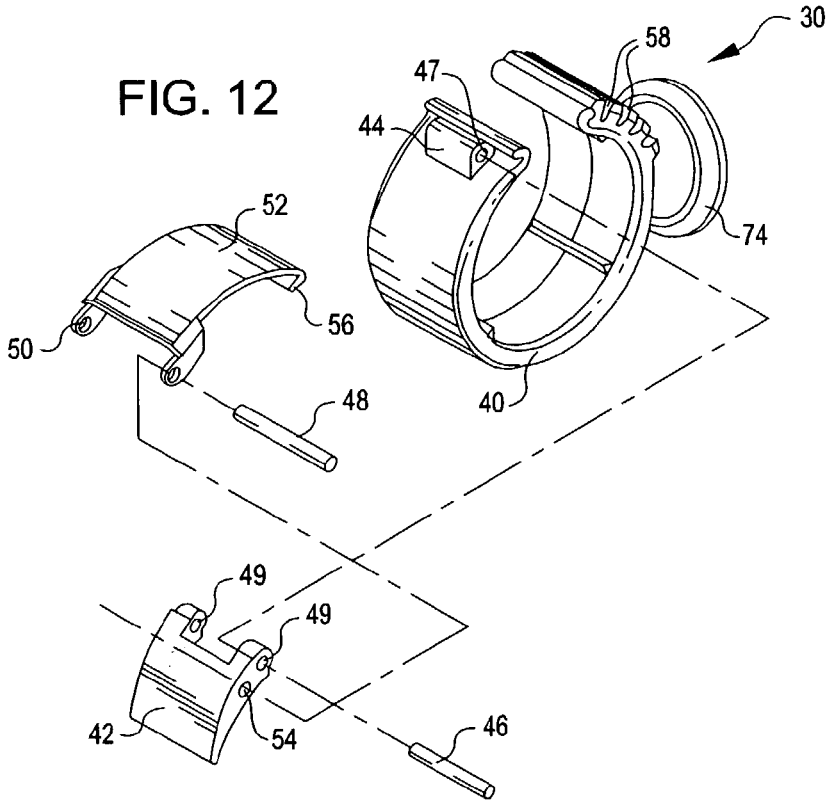
FIG. 12 is an exploded view of the club clamp of the training device of the present invention.

Club clamp 30, as shown in FIGS. 10 through 12, also includes thumb lever 42, which is pivotally secured to thumb lever attachment 44 on annulus 40 by attachment pin 46 that passes through eye 47 of thumb lever attachment 44 and through eyes 49 of thumb lever 42 which axially overlap with eye 48 of thumb lever attachment 44. Attachment pin 48 passes through eyes 50 of band 52 and through eye 54 of thumb lever 42, eye 54 axially overlapping with eyes 50 of band 52. Band 52 has lip 56 on its edge remote from eyes 50. In operation, annulus 40 of club clamp 30 is placed around golf club grip H with band 52 pivotally separated from annulus 40. Lip 56 is then secured in one of the plurality of grooves 58 radially disposed on annulus 40 as band 52 is pivoted toward annulus 40. Thumb lever 42 is then depressed toward annulus 40, closing club clamp 30 at the desired longitudinal and radial location on golf club grip H depending on the diameter of often tapering golf club grip H and the amount of "torqueing effect" (discussed further below) that is desired in order to alter the angular orientation of the club head and club face of the golf club in consistent, reproducible swings in order to elicit a hook or slice effect.

Figure 14:
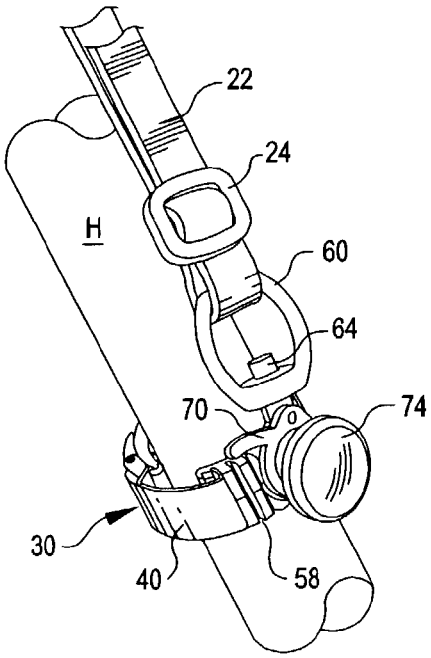
FIG. 14 is a detailed perspective view of the club clamp of the training device of the present invention on a golf club grip.
Figure 15:
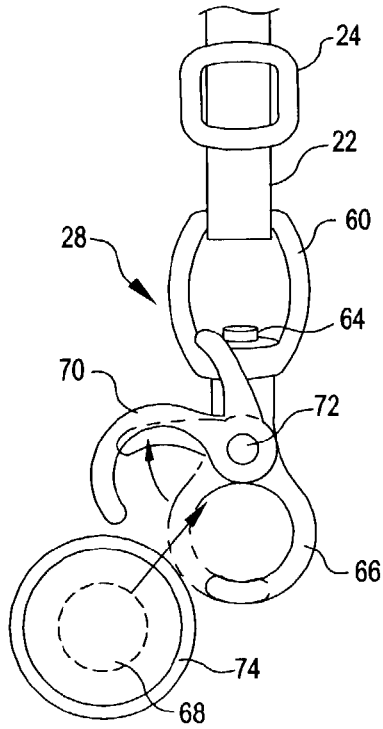
FIG. 15 is a top view of the attachment to a golf club grip of the club clamp and of the strap of the training device of the present invention.

Next referring to FIGS. 14 and 15, removable attachment of inelastic flexible strap 22 (which is calibrated by numbers along its length to allow the golfer to quickly identify their ideal swing radius) to club clamp 30 by swivel buckle or rotatable fastener 28 is described. Swivel buckle or rotatable fastener 28 is attached by ring 60 to the end of inelastic flexible strap 22 remote from the end thereof that is attachable to ring or attachment point 26 of chest plate 20 by snap fastener 62 (which can rotate with respect to inelastic flexible strap 22). Body 66 of swivel buckle or rotatable fastener 28 is attached to axle 64 and ring 60 rotates around axle 64 with respect to body 66. Body 66 has a substantially C-shaped portion in which shaft 68 of club clamp 30 is sized and shaped to fit. Attachment clasp 70 is also substantially C-shaped and is pivotally secured to body 66 of swivel buckle or rotatable fastener 28 by pivot point 72 in inverse or "mirror" orientation to the substantially C-shaped portion of body 30 such that, when pivoted in an "open" orientation attachment clasp 70 allows entry of shaft 68 of club clamp 30 into the substantially C-shaped portion of body 66, and when in a "closed" position attachment clasp 70 secures shaft 68 of club clamp 30 between itself, and the substantially C-shaped potion of body 60. Shaft 68 of club clamp 30 has head 74 on the end thereof remote from the end of attachment of shaft 68 to annulus 40 of club clamp 30. Head 74 is sized of a greater diameter than the orifice formed from the substantially C-shaped portion of body 60 and attachment clasp 70 when in their "closed" position such that shaft 68, and hence club camp 30, is secured thereto.

When club clamp 30 is secured to swivel buckle or rotatable fastener 28 as described in the previous paragraph, and annulus 40 of club clamp 30 is attached to the golf club grip H, the rotation of ring 60 of swivel buckle or rotatable fastener 28 with respect to body 66 (and around axle 64) is in a plane substantially parallel to the longitudinal axis of shaft 68 of club clamp 30, and axle 64 (the axis of rotation of ring 60 of swivel buckle or rotatable fastener 28 with respect to body 66) is substantially perpendicular to the longitudinal axis of shaft 68 of club clamp 30.

Club clamp 30 and rotatable fastener or swivel buckle 28 thus connect the lowermost portion of upper lever 34 of FIGS. 3, 4 and 5 to the uppermost portion of the grip of the golf club in such a way as to:

a. Accurately duplicate the anatomical hinge point of a golfer.

b. Provide an orientation of attachment perpendicular to the axis of the golf club shaft, which can be axially adjusted around the grip H of the golf club to produce a desired torqueing effect on the hands and clubface when in use, and linearly adjusted to different locations on the grip H of the club. By not limiting the end user to a predetermined mounting location as seen in the prior art, the golfer can now pre-determine the desired "torqueing effect" by rotating the club clamp 30 into a desired position.

While preferred embodiments of the present invention have been described, it is to be understood that the embodiments described are illustrative only and that the scope of the invention is to be defined solely by the appended claims when accorded a full range of equivalence, many variations and modifications naturally occurring to those of skill in the art from a perusal hereof.

We claim:

1. A golf swing training device worn by a golfer to develop a golf swing in which the golfer's hands move at a constant radius from a point on the golfer's chest without inhibiting the hinged movement of the golfer's wrists, thereby maintaining a proper swing radius and allowing the golfer to experience a proper two-lever golf swing, said device comprising:

an adjustable upper body harness that is adjustable to accommodate golfers of various size and that is configured to supply tension to a golfer during a golf swing;

a chest plate on said adjustable upper body harness;

plurality of strap attachment points on said chest plate, wherein one of said plurality of strap attachment points defines a fulcrum of a golfer's swing; and a flexible yet substantially inelastic adjustable length golf club strap selectively attached to one of said plurality of strap attachment points and supporting a rotatable attachment to a club clamp on the distal end of said strap, said club clamp being configured for attachment to the grip end of a golf club and adjustable to control the orientation of a club face without interfering with the hinged movement of the golfer's wrists.

2. The golf swing training device of claim 1 wherein said adjustable upper body harness includes a chest strap and two shoulder straps.

3. The golf swing training device of claim 1 wherein said plurality of strap attachment points are three in number.

4. The golf swing training device of claim 1 wherein said plurality of strap attachment points are substantially vertically disposed on said chest plate.

5. A golf swing training device worn by a golfer to develop a golf swing in which the golfer's hands move at a constant radius from a point on the golfer's chest without inhibiting the hinged movement of the golfer's wrists, thereby maintaining a proper swing radius and allowing the golfer to experience a proper two-lever golf swing, said device comprising:

an adjustable upper body harness that is adjustable to accommodate golfers of various size and that is configured to supply tension to a golfer during a golf swing;

a chest plate on said adjustable upper body harness;

a plurality of strap attachment points on said chest plate, wherein one of said plurality of strap attachment points defines a fulcrum of a golfer's swing;

a flexible yet substantially inelastic adjustable length golf club strap selectively attached to one of said plurality of strap attachment points of said chest plate and having an end remote from attachment to said chestplate with a rotatable fastener thereon securable to a club clamp; and a club clamp securable to a golf club handle and having an annulus of adjustable diameter to accommodate golf club handles of different diameters, said annulus being axially rotatable around a golf club handle to accommodate variable golf club head angular orientations in a consistent golf swings, said club clamp having a shaft on said annulus with a head thereon wider than said shaft, said shaft having a longitudinal axis that is substantially perpendicular to the longitudinal axis of an attached golf club, said shaft being sized and shaped to accommodate the attachment of said rotatable fastener of said golf club strap therearound such that rotation of said rotatable fastener is in a plane substantially parallel to said longitudinal axis of said shaft.

6. The golf swing training device of claim 5 wherein said adjustable upper body harness includes a chest strap and two shoulder straps.

7. The golf swing training device of claim 5 wherein said plurality of strap attachment points are three in number.

8. The golf swing training device of claim 5 wherein said plurality of strap attachment points are substantially vertically disposed on said chest plate.

9. A golf swing training device worn by a golfer to develop a golf swing in which the golfer's hands move at a constant radius from a point on the golfer's chest without inhibiting the hinged movement of the golfer's wrists, thereby maintaining a proper swing radius and allowing the golfer to experience a proper two-lever golf swing, said device comprising:

an adjustable upper body harness that is adjustable to accommodate golfers of various size and that is configured to supply tension to a golfer during a golf swing;

a chest plate on said adjustable upper body harness;

a plurality of strap attachment points on said chest plate, wherein one of said plurality of strap attachment points defines a fulcrum of a golfer's swing;

a flexible yet substantially inelastic adjustable length golf club strap selectively attached to one of said more than one strap attachment point of said chest plate and having an end remote from attachment to said chestplate with a rotatable fastener thereon securable to a club clamp, said rotatable fastener having an axis of rotation; and a club clamp securable to a golf club handle and having an annulus of adjustable diameter to accommodate golf club handles of different diameters, said annulus being axially rotatable around a golf club handle to accommodate variable golf club head angular orientations, said club clamp having a shaft on said annulus with a head thereon wider than said shaft, said shaft having a longitudinal axis substantially perpendicular to the longitudinal axis of an attached golf club, said shaft sized and shaped to accommodate the attachment of said rotatable fastener of said golf club strap therearound such that said axis of rotation of said rotatable fastener is substantially perpendicular to said longitudinal axis of said shaft.

10. The golf swing training device of claim 9 wherein said adjustable upper body harness includes a chest strap and two shoulder straps.

11. The golf swing training device of claim 9 wherein said plurality of strap attachment points are three in number.

12. The golf swing training device of claim 9 wherein said plurality of strap attachment points are substantially vertically disposed on said chest plate.

* * * * *